United States Patent [19]

Porter

[11] Patent Number: 4,745,760

[45] Date of Patent: May 24, 1988

[54] CRYOGENIC FLUID TRANSFER CONDUIT

[75] Inventor: Warren W. Porter, Escondido, Calif.

[73] Assignee: NCR Corporation, Dayton, Ohio

[21] Appl. No.: 76,414

[22] Filed: Jul. 21, 1987

[51] Int. Cl.[4] ..... F17C 7/02

[52] U.S. Cl. ..... 62/55; 62/514 R

[58] Field of Search ..... 62/55, 514 R

[56] References Cited

U.S. PATENT DOCUMENTS

| | | | |
|---|---|---|---|
| 3,162,716 | 12/1964 | Silver | 62/514 R |
| 3,309,884 | 3/1967 | Pauliukonis | 62/45 |
| 3,377,813 | 4/1968 | Mordhorst | 62/45 |
| 3,463,869 | 8/1969 | Cooley et al. | 62/514 R |
| 3,483,709 | 12/1969 | Baicker et al. | 62/514 R |
| 3,714,942 | 2/1973 | Fischel et al. | 62/45 |
| 4,027,728 | 6/1977 | Kobayashi et al. | 165/104.27 |
| 4,535,596 | 8/1985 | Laskaris | 62/514 R |

*Primary Examiner*—Ronald C. Capossela
*Attorney, Agent, or Firm*—Wilbert Hawk, Jr.; Edward Dugas; Jack R. Penrod

[57] ABSTRACT

A non-conducting, plastic type of cryogenic fluid transfer conduit is presented which is suitable for transferring the cryogenic fluid from a standard reservoir into the midst of an electronics cabinet, such as a mini-computer, to cryogenically cool electronic components. When connected to a suitable enclosure, in which the electronic components to be cooled are mounted, the conduit transfers the cryogenic fluid from the reservoir to the enclosure with an acceptably low heat loss. The conduit subsequently transports the "warmed" cryogenic fluid, which picked up heat by cooling the electronic components, to the region of the reservoir where most or all of this "warmed" cryogenic fluid is vented either to the external environment, or back to the reservoir where it is subsequently cooled by a cryogenic refrigeration unit for re-use. A thermally insulating and moisture preventing outer covering allows the transition of the temperature from the cryogenic level to room temperature level to occur almost completely within the outer covering and, thereby, prevents the moisture condensation problems incurred if the surface temperature of the cryogenic conduit drops below the dew point of the operating environment.

19 Claims, 2 Drawing Sheets

FIG. 2
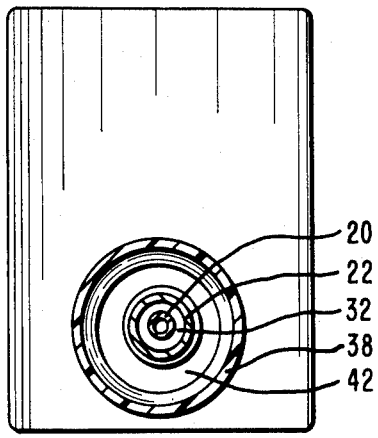
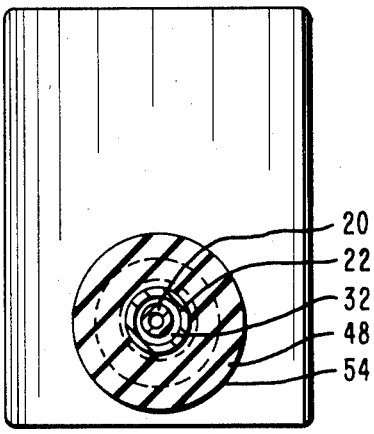
FIG. 5
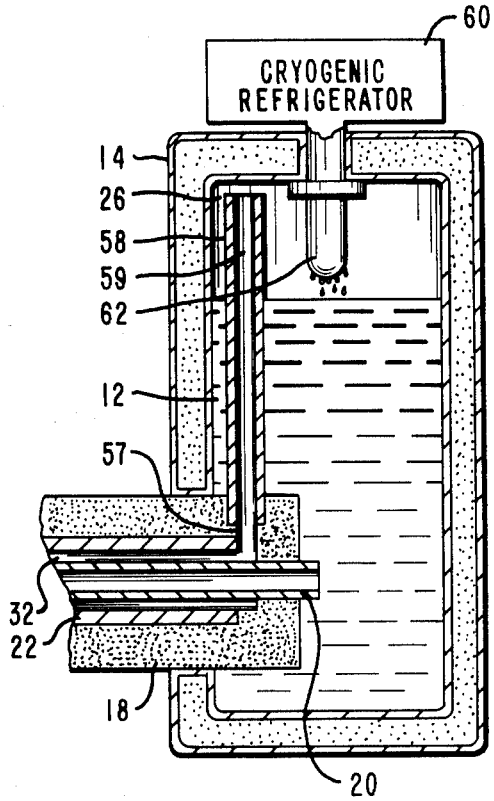
FIG. 6
FIG. 3
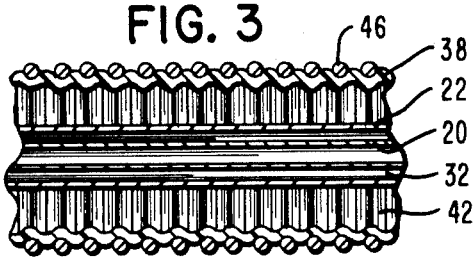

CRYOGENIC FLUID TRANSFER CONDUIT

BACKGROUND OF THE INVENTION

This invention relates to the field of cryogenic fluid transfer conduits and more particularly to cryogenic fluid transfer conduits used for cooling electronic integrated circuit packages.

Cryogenic fluids, such as liquid nitrogen ($LN_2$), are known in the electrical arts both to lower the resistance of electrical conductors, and to remove "waste" heat generated by the passage of electrical current through materials which have resistance. For both purposes, cryogenic fluids are now being used to cool VLSI integrated circuits in computer applications. The reduction of resistance as a function of temperature means that some logic circuits increase in switching speed as the temperature of the integrated circuitry decreases. Moreover, the use of cryogenic fluids for the removal of "waste" heat permits the use of very high gate densities without unwanted temperature increases. Higher gate densities decrease the transit delay times between gates and further improve the switching times. Thus, the application of cryogenic fluids to computer VLSI circuits has important advantages.

Unfortunately, the devices known from existing patents for the application and transport of a cryogenic fluid to electrical and/or electronic hardware are inappropriate for the application and transport of a cryogenic fluid to general purpose, VLSI computer circuits. For example, U.S. Pat. No. 4,027,728 issued June 7, 1977, describes a non-cryogenic fluid cooling system which is too big and bulky to mount inside a computer cabinet. In addition to the problem associated with the physical size limitations, at cryogenic temperatures the transport conduits to and from the cooling chamber would soon be covered with liquid or frozen condensed water vapor. This is a significant problem because water within a computer cabinet can cause corrosion and/or unwanted signal coupling, both of which are unacceptable. Therefore, the use of a device according to this patent within a VLSI computer system is not desirable.

U.S. Pat. Nos. 3,162,716 issued Dec. 22, 1964, and 3,463,869 issued Aug. 26, 1969, describe systems which use cryogenic cooling. Included in each of these systems is a type of counter flow for better utilization of the cryogenic fluid. The differences, however, between the technology of the power distribution field from which these two patents are taken and the technology of the computer field are so great that only general background information about cryogenic cooling is provided. Information which is not readily adaptable to the field of VLSI computers. For example, the cryogenic fluid transfer conduit in each of the above referenced patents is manufactured out of metallic components, which tend, because of a good thermal conductance, to collect condensation either as liquid water or as ice crystals. The good thermal conductance is also accompanied by a good electrical conductance which can cause electrical short circuits unless strict observance to operating and maintenance procedures are adhered to. Moreover, a metallic conduit in a computer system tends to act as an antenna which could introduce unwanted signals into the system and also couple parasitic signals from inside the computer system to the outside environment. For these reasons, the two above mentioned patents from the electric power field do not disclose a cryogenic fluid transfer conduit which could be used or adapted for use with VLSI computer circuits within a typical electronic enclosure.

The use of a stainless steel, vacuum insulated conduit has been applied in the laboratory to prototypes of cryogenic, VLSI computer circuits, with less than ideal results. The stainless steel, vacuum insulated conduit is very rigid because it is composed of two concentric steel cylinders that are welded together at each end in order to seal in the vacuum. Such construction requires the vacuum conduit to be pre-formed during manufacture to the exact size and shape to fit within the computer enclosure. Even with a careful manufacturing process, the seals formed are not perfect and to maintain a good insulating vacuum, periodic removal for re-evacuation and resealing is necessary.

Stainless steel, vacuum insulated conduit is costly because of the expense of the stainless steel material, and because of the expense of the shaping procedures. Both expenses contribute to a high manufacturing cost. Additionally, because it is metallic, a stainless steel, vacuum insulated conduit also has the aforementioned problems of providing possible short circuit paths, as well as, conducting parasitic noise into and out of the internal regions of the computer system. Further, because at each end of the stainless steel, vacuum insulated conduit there is a metal-to-metal seal which is required to maintain the thermally insulating vacuum, each end is also is a thermally high conducting region which is not vacuum insulated. This region, at each end, typically collects ice and/or dripping condensation when operated in typical room temperature and humidity conditions.

It is an object of this invention to provide a cryogenic fluid conduit suitable for application within an electronics cabinet which does not collect ice or drip water anywhere along its extent.

It is another object of this invention to provide a small and flexible cryogenic fluid transfer conduit which can be readily cut to length.

It is a further object of this invention to provide a cryogenic fluid transfer conduit which is electrically non-conducting to prevent possible short circuits, and the transfer of parasitic noise either into or out of an electronics cabinet.

It is a further object of this invention to provide a cryogenic fluid transfer conduit which is inexpensive.

SUMMARY OF THE INVENTION

Briefly stated, in accordance with one aspect of the invention, the aforementioned objects are achieved by providing a cryogenic fluid transfer apparatus used for transferring a cryogenic fluid from a cryogenic reservoir to an enclosure for cooling an integrated circuit comprising a coupling member having a venting passage therein, connected to the cryogenic reservoir. A first conduit is connected to the coupling member at one end and to the enclosure at the other end for transferring the cryogenic fluid from the cryogenic reservoir in a first direction to the enclosure at a first temperature. A second conduit is connected to the enclosure and the coupling member, and circumferentially located around the first conduit for transferring the cryogenic fluid from the enclosure at a higher temperature in a direction opposite to the first direction. The second conduit communicates with the venting passage for venting the fluid at the higher temperature. An insulating device is connected to the coupling member and the enclosure around the second conduit for preventing the condensation of moisture from the operating environment.

In a further aspect of the invention, the thermal insulation device includes a third conduit which is circumferentially located around the second conduit over the entire length thereof. The third conduit is sealed and maintained in a substantially concentric relationship with the second conduit by the coupling member. The third conduit keeps moisture from condensing on the conduits enclosed therein and maintains its own external surface at a temperature substantially equal to the environment to prevent the condensation of moisture thereon.

In another aspect of the of the invention, the aforementioned objects are achieved by providing a cryogenic fluid transfer conduit for use between an external cryogenic fluid reservoir and a cryogenically cooled electronic circuit within an electronics cabinet. The cryogenic fluid transfer conduit includes an inner conduit for carrying the cryogenic fluid from the source to the electronic circuit. A second conduit surrounds the inner conduit over the entire length thereof for carrying the cryogenic fluid from the electronic circuit toward the reservoir. A coupling member is connected at the reservoir end of the cryogenic fluid transfer conduit between the inner conduit and the second conduit for sealing the reservoir end of the second conduit and maintaining the inner conduit in a substantially concentric relationship with the second conduit. A passage is located within the coupling member and communicates with the interior of the second conduit for allowing passage of the cryogenic fluid therein from the interior thereof to the exterior thereof. A thermal insulating foam surrounds the second conduit over the length thereof and surrounds a portion of the coupling member for keeping moisture from condensing on the conduits therein, while maintaining its own external surface temperature substantially equal to the ambient environment to prevent the condensation of moisture thereon.

BRIEF DESCRIPTION OF THE DRAWINGS

While the specification concludes with a number of claims particularly pointing out and distinctly claiming the subject matter which is regarded as the invention, it is believed that the invention will be better understood from the following description of the preferred embodiment taken in conjunction with the accompanying drawings, which form a part of the present disclosure and in which like characters indicate like parts.

FIG. 2 is a sectional view taken along section line 2—2 in FIG. 1;

FIG. 3 is a sectional view of a further embodiment of the invention shown in FIG. 1;

FIG. 5 is a sectional view taken along section line 5—5 of FIG. 4; and FIG. 6 is a cut-away sectional view of a closed system embodiment of the invention according to either of the embodiments thereof shown in FIGS. 1 and 4.

DESCRIPTION OF A PREFERRED EMBODIMENT

Figure 1:
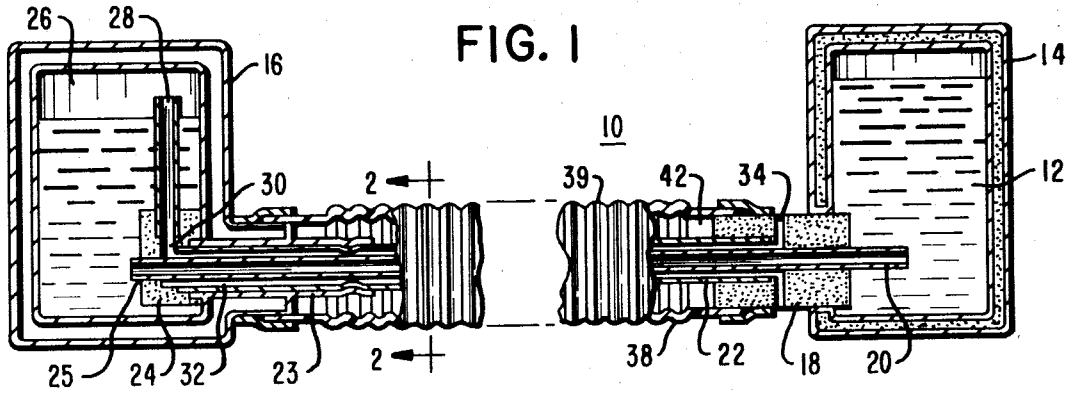
FIG. 1 is a sectional view of an embodiment of the invention.

Referring now to FIGS. 1 and 2, a cryogenic fluid transfer conduit 10 is shown for transferring a cryogenic fluid 12 between a cryogenic reservoir 14 and a cryogenic cooling enclosure 16, such as is used for cooling an integrated circuit. The cryogenic fluid transfer conduit 10 has a coupling member 18 which is connected to the reservoir 14. An inner conduit 20 penetrates through the coupling member 18 and communicates with the cryogenic fluid 12 within the reservoir 14. The inner conduit 20 is tightly held by the coupling member 18 to prevent leakage of the cryogenic fluid 14 at this junction.

Beginning within the coupling member 18, a second cryogenic conduit 22 surrounds the inner conduit 20 for the length between the reservoir 14 and the cryogenic cooling enclosure 16. The second conduit 22 terminates within the coupling member 18 and is tightly held thereby in order to keep the second conduit 22 in a substantially concentric and coaxial relationship with the inner conduit 20 in the region of the coupling member 18. The two conduits 20,22 enter the cryogenic cooling enclosure 16 through an entry flange 23 and terminate at a terminal block 24 in a manner similar to the termination at member 18. The inner conduit 20 penetrates through a hole 25 in the terminal block 24 to communicate with the interior of the cryogenic cooling enclosure 16, while the second conduit 22 terminates within the terminal block 24. The combination of the terminal block 24, the flange 23, and the second conduit 22 forms a seal to prevent leakage of the cryogenic fluid 12 out of the enclosure 16.

Inside the enclosure 16, the terminal block 24 has an exhaust passage 30 which communicates with the interior volume 32 of the second conduit 22. The wall of the terminal block hole 25 fits tightly against the inner conduit 20 to prevent leakage of the cryogenic fluid 12 into the exhaust passage 30 or the interior volume 32.

To cool a device, such as an integrated circuit, within the enclosure 16; the cryogenic fluid 12 travels from the cryogenic reservoir 14, where a large quantity of the fluid 12 is stored, through the inner conduit 20 and into the interior of the enclosure 16. The pressure required to cause the fluid to flow is supplied by the weight of the column of fluid stored in the reservoir 14 and can be increased or decreased by the application of known techniques. The enclosure 16 is very well insulated in order to reduce the cooling requirements, as near as possible, to the removal of the "waste" heat generated by the integrated circuit contained therein. Heat entering the enclosure 16 causes the cryogenic fluid, which preferably is liquid nitrogen, to evaporate and/or boil into a slightly higher temperature cryogenic fluid 26, which preferably is gaseous nitrogen. Thus the heat energy causes the lower temperature fluid 12 to absorb energy and, in some cases, even to change from the liquid state to the gaseous state.

The higher temperature cryogenic fluid 26 exits from the enclosure 16 by the exhaust passage 30 into the interior volume 32 of the second conduit 22. If a higher surface level of lower temperature cryogenic fluid 12 is desired, an extension tube 28 may be connected to the terminal block 24 at exhaust passage 30 to thereby increase the level which the cryogenic fluid 12 may attain before it drains into the exhaust passage 30. The higher temperature cryogenic fluid 26 flows under the pressure of the lower temperature cryogenic fluid 12 and the vapor pressure, if any, of the higher temperature fluid 26 through the interior volume 32 of the second conduit 22 back towards the coupling member 18. Even though it has a higher temperature, the cryogenic fluid 26 is very cold and is capable of absorbing heat that is conducted from the environment through the walls of the second conduit 22. In this manner, the higher temperature cryogenic fluid 26 operates as a very good thermal insulator for the inner conduit 20 and the lower temperature cryogenic fluid 12 flowing therein.

The counter flow of the higher temperature fluid 26 provides an additional important feature besides that of thermal insulation. The counter flow of fluid 26 keeps moisture from collecting on the outside of the inner conduit 20. This is possible because as long as the lower temperature fluid 12 does not contain any moisture (i.e., water) then the counter flow of higher temperature fluid 26 along inner conduit cannot contain any moisture to collect anywhere. Moreover, by maintaining the pressure in the volume 32 above atmospheric pressure, moisture bearing room air is prevented from entering to condense or freeze upon the inner conduit 20.

To prevent condensation or freezing of environmental moisture on the outside of the conduit 22, a corrugated conduit 38 is circumferentially located around the second conduit 22 between the coupling member 18 and the flange 23. This corrugated conduit 38 is connected to and sealed around the outside of flange 23 at the enclosure 16 on one end and connected to and sealed around the coupling member 18 at the reservoir 14 on the other end. Any trace of moisture trapped between the corrugated conduit 38 and the second conduit 22 is sealed away from the nearby electronic components and is sealed off from moisture accumulation from the external environment.

The higher temperature fluid leaves the volume 32 and enters an exit passage 34 formed within coupling member 18. The exit passage 34 vents the fluid 26, flowing within the volume 32, to the external environment. The dimensions of the corrugated conduit 38 are selected according to known thermal principles such that the temperature of its external surface 39 does no fall below the dew point for the environmental conditions it is located in, thereby, preventing condensation.

The conduit 38 has a significantly larger diameter than the conduits 20,22 which could lead to kinking or creasing of the conduit wall if subjected to short radius of curvature bends. As a preventative measure, the conduit 38 is corrugated, which prevents stress localization that leads to kinking and creasing, and has the added benefit of increasing flexibility.

A further embodiment of the invention is shown in FIG. 3, in which a helical coil spring 46 is circumferentially located around the outside of the corrugated conduit 38 to further reduce the localization of bending stresses that could cause kinking and creasing. The spring is almost completely insulated by the conduit 38 and does not extend all the way to the flange 23. By these precautions, the spring will not act as a ready source of accidental short circuits and will not act as an antenna conducting noise into or out of the enclosure 16. Moreover, if grounded at the reservoir end, the spring 46 will provide a shield against parasitic signals.

Figure 4:
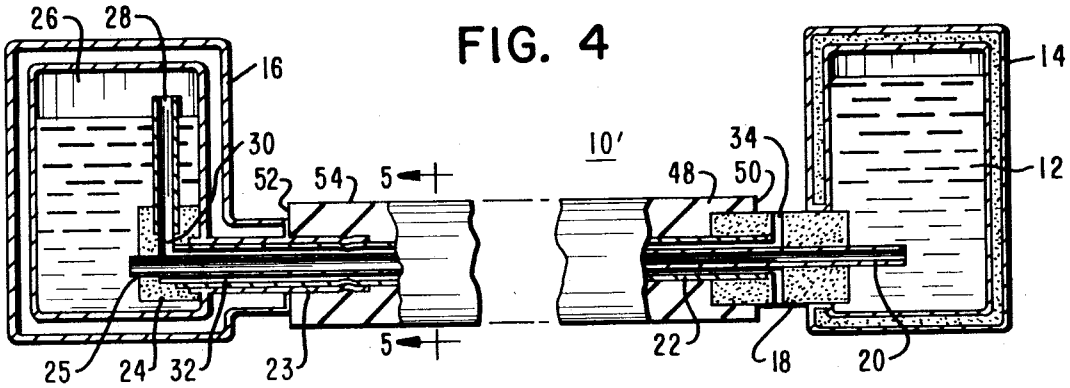
FIG. 4 is a sectional view of another embodiment of the invention.

Referring now to FIGS. 4 and 5, a second embodiment of the invention will be discussed. The cryogenic fluid transfer conduit 10' is substantially identical to the cryogenic fluid transfer conduit 10 shown in FIGS. 1 and 2, except that instead of the corrugated conduit 38 to prevent the collection of moisture on the second conduit 22, a foam insulating layer 48 is provided between the coupling member 18 to the flange 23. The foam insulating layer 48 forms an air-tight seal at its junction with the coupling member 18 and its junction with the flange 23 to prevent the seepage of moisture bearing air along the interface of the insulating layer 48 and the second conduit 22. The ends 50,52 and the outside surface 54 of the insulating layer 48 are likewise sealed, by either the construction of the foam or by a sealed covering of all external surfaces, to prevent entry and collection of moisture within the foam. The thickness of the foam is selected, in a known way, such that the temperature of any external surface 50,52,54 is not below the dew point for the environment it is located within. This prevents moisture from condensing upon the insulating layer 48 when operated within a typical environment for electronic equipment.

Referring now to FIG. 6, a closed system version of either the embodiment shown in FIG. 1, or the embodiment shown in FIG. 4, will be discussed. The coupling member 18 holds the inner conduit 20 just as in the previous embodiments, but in this closed system embodiment the coupling member extends a little bit farther into the reservoir 14. The second conduit 22 likewise extends a bit farther, such that it penetrates into the reservoir 14, but otherwise is still held in a circumferential relationship with the inner conduit 20 as in the previous embodiments. The external vent passage 34, shown in FIGS. 1 and 4, is superseded by an internal venting passage 57 which communicates with the interior volume 32 of the second conduit 22. A riser tube 58 is mounted to the coupling member 18 within a portion of the internal venting passage 57, such that an internal volume 59 of the riser tube 58 communicates with the passage 57 and the interior volume 32. The riser tube 58 receives the higher temperature fluid 26 flowing from the interior volume 32 and transports it to the region within reservoir 14 which is above the lower temperature cryogenic fluid 12. Also in this region is a cooling element 62 of a cryogenic refrigeration unit 60. The cooling element 62 lowers the temperature of the higher temperature fluid 26 by conductive cooling to the temperature of the lower temperature fluid 12, thereby forming a closed cryogenic cooling system. If the higher temperature fluid 26 is gaseous, the cryogenic cooling element condenses the gas back to its lower temperature, liquid state.

The outer, thermal insulation, either the third conduit 38 as shown in FIG. 1 or the insulating foam 48 as shown in FIG. 4, in the closed system embodiment also forms moisture preventing seals with the flange 23 and the coupling member 18 to prevent moisture from the environment from collecting on the second conduit 22. However, moisture is prevented from collecting inside of conduits 20 and 22 by virtue of the closed system configuration. There is no moisture initially within the system and since the system is closed, moisture does not have an opportunity to gain access into the system. Thus, the undesirable water or ice is prevented from causing problems by being locked out of the closed system.

The preferred material for the inner conduit 20; the second conduit 22; and, in the embodiment of FIG. 1, the corrugated conduit 38; is a thermoplastic fluro-carbon polymer such as sold by E. I. Du Pont de Nemours and Co. under the trademark Teflon. This material is inexpensive, as are other thermoplastic materials, but unlike hydro-carbon polymers, flurocarbon polymers remain bendable and do not become brittle at cryogenic temperatures. Moreover, flurocarbon polymers can be cut and formed at room temperature just like any other thermoplastic material and, therefore, are well suited for this new application.

While there has been shown what is considered to be the preferred embodiment of the invention, it will be manifest that many changes and modifications may be made therein without departing from the essential spirit of the invention. It is intended, therefore, in the annexed claims, to cover all such changes and modifications as fall within the true spirit and scope of the invention.

I claim:

1. A cryogenic fluid transfer apparatus used for transferring a cryogenic fluid from a cryogenic reservoir to an enclosure for cooling an integrated circuit comprising:

coupling means, having a venting passage therein, connected to the cryogenic reservoir;

a first conduit means connected to said coupling means at one end and to said enclosure at the other end for transferring the cryogenic fluid from said cryogenic reservoir in a first direction to said enclosure at a first temperature;

a second conduit means connected to said enclosure and said coupling means, and circumferentially located around said first conduit means for transferring the cryogenic fluid from said enclosure at a higher temperature in a direction opposite to said first direction;

said second conduit means communicating with said venting passage for venting said fluid at said higher temperature; and insulating means connected to said coupling means and said enclosure around said second conduit means for preventing the condensation of moisture from the operating environment.

2. The cryogenic fluid transfer apparatus, according to claim 1, wherein:

said insulating means includes a third conduit sealably connected to said coupling means at one end and to said enclosure at the other end thereof; and said third conduit is circumferentially located around said second conduit means.

3. The cryogenic fluid transfer apparatus, according to claim 2, wherein said third conduit has a corrugated wall.

4. The cryogenic fluid transfer apparatus, according to claim 3, wherein said first conduit means, said second conduit means and said third conduit are made of a plastic material which is an electrical insulator.

5. The cryogenic fluid transfer apparatus, according to claim 4, wherein said plastic material remains flexible at cryogenic temperatures.

6. The cryogenic fluid transfer apparatus, according to claim 5, wherein said plastic material is a fluro-carbon polymer.

7. The cryogenic fluid transfer apparatus, according to claim 6, further comprising a helical spring circumferentially located around said third conduit.

8. The cryogenic fluid transfer apparatus, according to claim 1, wherein said insulating means is a foam layer sealably connected to said coupling means, said enclosure, and said second conduit means.

9. The cryogenic fluid transfer apparatus, according to claim 8, further comprising sealing means for sealing the external surface of said foam layer against the entrance of moisture.

10. The cryogenic fluid transfer apparatus, according to claim 9, wherein said first and second conduit means are made of a plastic material which is an electrical insulator.

11. The cryogenic fluid transfer apparatus, according to claim 10, wherein said plastic material remains flexible at cryogenic temperatures.

12. The cryogenic fluid transfer apparatus, according to claim 11, wherein said plastic material is a fluro-carbon polymer.

13. A cryogenic fluid transfer apparatus used for transferring a cryogenic fluid from a cryogenic reservoir to an enclosure for cooling an integrated circuit and for returning the fluid to the cryogenic reservoir, comprising:

coupling means, having an internal venting passage therein, connected to the cryogenic reservoir;

a first conduit means connected to said coupling means at one end and to said enclosure at the other end thereof for transferring the cryogenic fluid from said cryogenic reservoir in a first direction to said enclosure at a first temperature;

a second conduit means connected to said enclosure and said coupling means, and circumferentially located around said first conduit means for transferring the cryogenic fluid from said enclosure at a higher temperature in a direction opposite to said first direction;

said second conduit means communicating with said internal venting passage thereby venting said fluid at said higher temperature within said cryogenic reservoir; and insulating means sealably connected to said coupling means and said enclosure around said second conduit means for preventing the condensation of moisture from the operating environment.

14. The cryogenic fluid transfer apparatus, according to claim 13, wherein:

said insulating means includes a third conduit sealably connected to said coupling means at one end and to said enclosure at the other end thereof; and said third conduit is circumferentially located around said second conduit means.

15. The cryogenic fluid transfer apparatus, according to claim 14, wherein said third conduit has a corrugated wall.

16. The cryogenic fluid transfer apparatus, according to claim 15, wherein said first conduit means, said second conduit means and said third conduit are made of a plastic fluro-carbon material.

17. The cryogenic fluid transfer apparatus, according to claim 13, wherein said insulating means is a foam layer sealably connected to said coupling means, said enclosure, and said second conduit means.

18. The cryogenic fluid transfer apparatus, according to claim 17, further comprising sealing means for sealing the external surface of said foam layer against the entrance of moisture.

19. The cryogenic fluid transfer apparatus, according to claim 18, wherein said first and second conduit means are made of a plastic, fluro-carbon material.

* * * * *